United States Patent [19]

Anders

[11] Patent Number: 4,508,182

[45] Date of Patent: Apr. 2, 1985

[54] METHOD AND APPARATUS FOR CONTROLLING AZIMUTHAL DRIFT OF A DRILL BIT

[75] Inventor: Edward O. Anders, Houston, Tex.

[73] Assignee: Dailey Petroleum Services Corp., Conroe, Tex.

[21] Appl. No.: 515,199

[22] Filed: Jul. 20, 1983

[51] Int. Cl.[3] ..... E21B 7/04

[52] U.S. Cl. ..... 175/61; 175/74; 138/114; 138/148

[58] Field of Search ..... 175/61, 74, 75; 285/330; 138/113, 114, 148, DIG. 5; 464/18, 19, 20, 160, 183; 267/57, 154

[56] References Cited

U.S. PATENT DOCUMENTS

| | | | |
|---|---|---|---|
| 2,232,638 | 2/1966 | Hollander | 138/DIG. 5 |
| 2,893,719 | 7/1959 | Gattiker, Jr. et al. | 267/154 |
| 3,033,011 | 5/1962 | Garrett | 64/11 |
| 3,092,188 | 6/1963 | Farris et al. | 175/76 |
| 3,586,116 | 6/1971 | Tiraspulsky | 175/256 |
| 3,718,326 | 2/1973 | Ristau | 267/154 |
| 4,300,636 | 11/1981 | Lawrence | 166/334 |
| 4,310,059 | 1/1982 | Moore | 175/320 |

OTHER PUBLICATIONS

Eastman Whipstock brochure from 1982–1983 General Catalog.

*Primary Examiner*—Stephen J. Novosad
*Assistant Examiner*—Mark J. Del Signore
*Attorney, Agent, or Firm*—Arnold, White & Durkee

[57] ABSTRACT

A method of and apparatus for controlling the azimuthal drift of a drill bit in an inclined well bore is described. The method comprises prestressing a drill collar member in torsion to adjust the angle in the horizontal plant that the drill bit makes with the longitudinal axis of the well bore when the drill collar is subjected to the gravitational, axial, and torsional forces of the drilling operation. The drill collar includes an inner tubular member and an outer tubular member. The two are held against relative rotation at one end. The desired torque is placed in the members by rotating the other ends of the members relative to each other in the desired direction. A splined member engages grooves in the inner and outer surfaces of the members to hold the members in their prestressed state.

9 Claims, 14 Drawing Figures

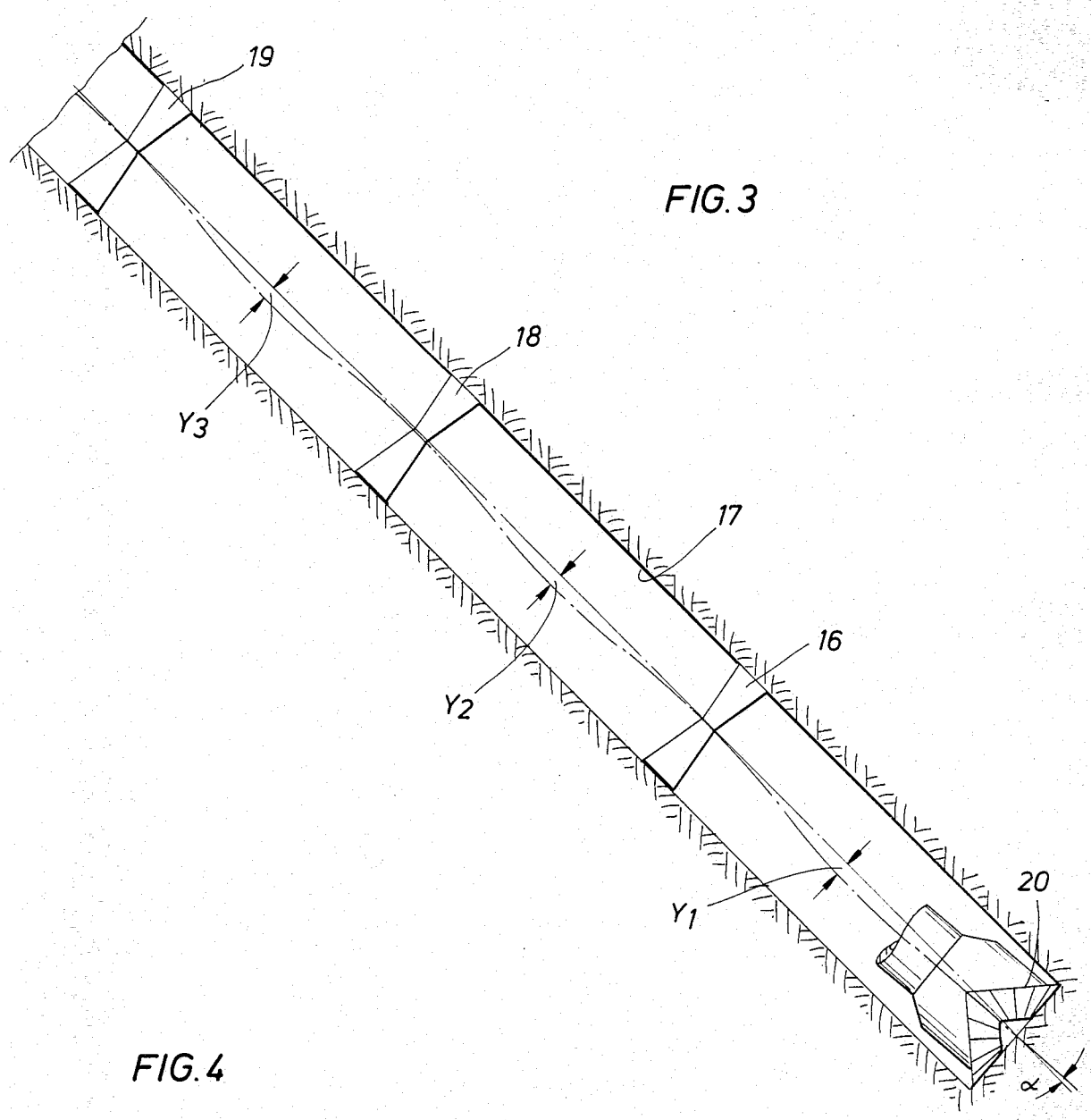
FIG. 3
FIG. 4
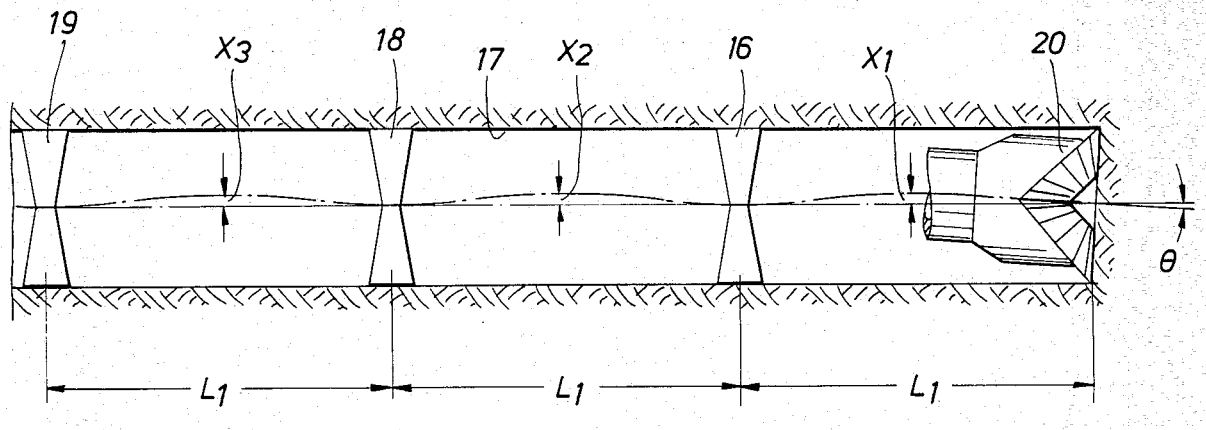

FIG. 5A
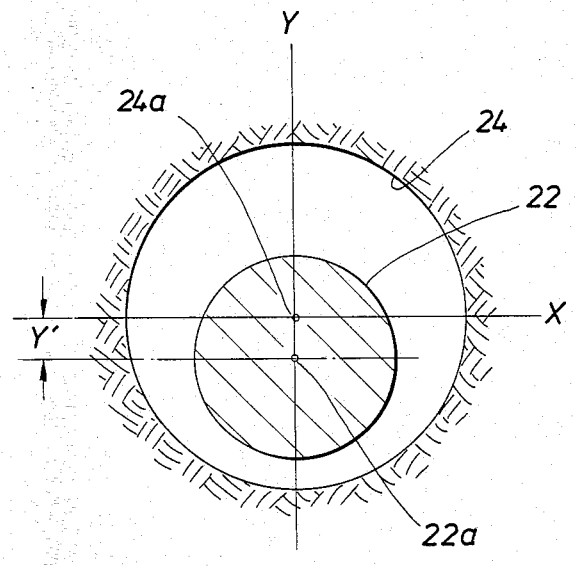
FIG. 5B
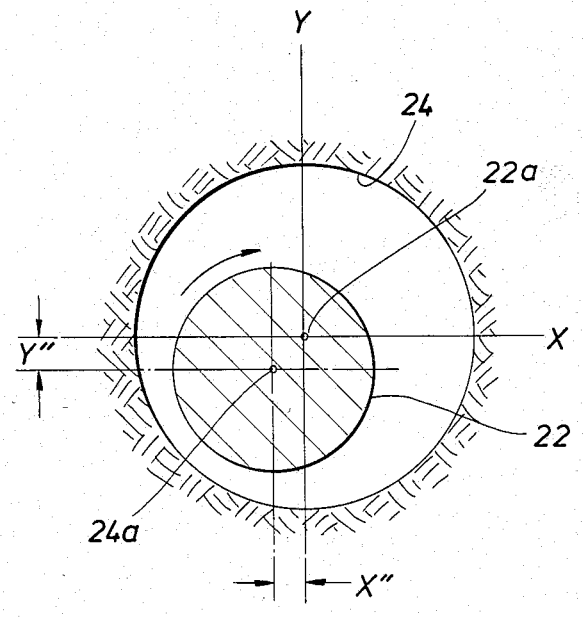
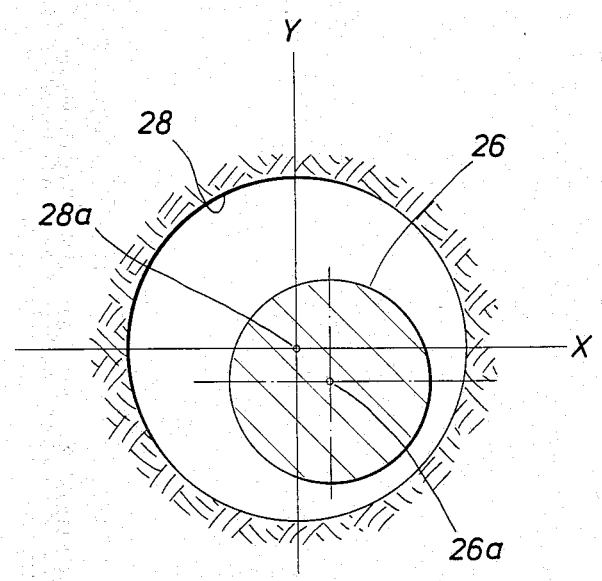
FIG. 6A
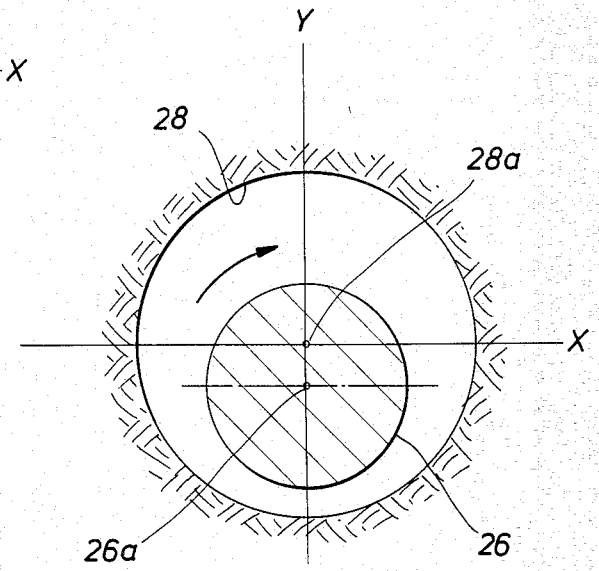
FIG. 6B

FIG. 8
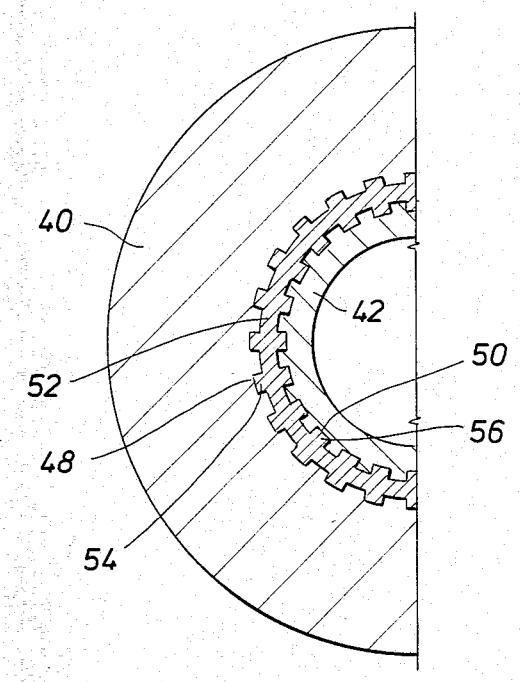
FIG. 9
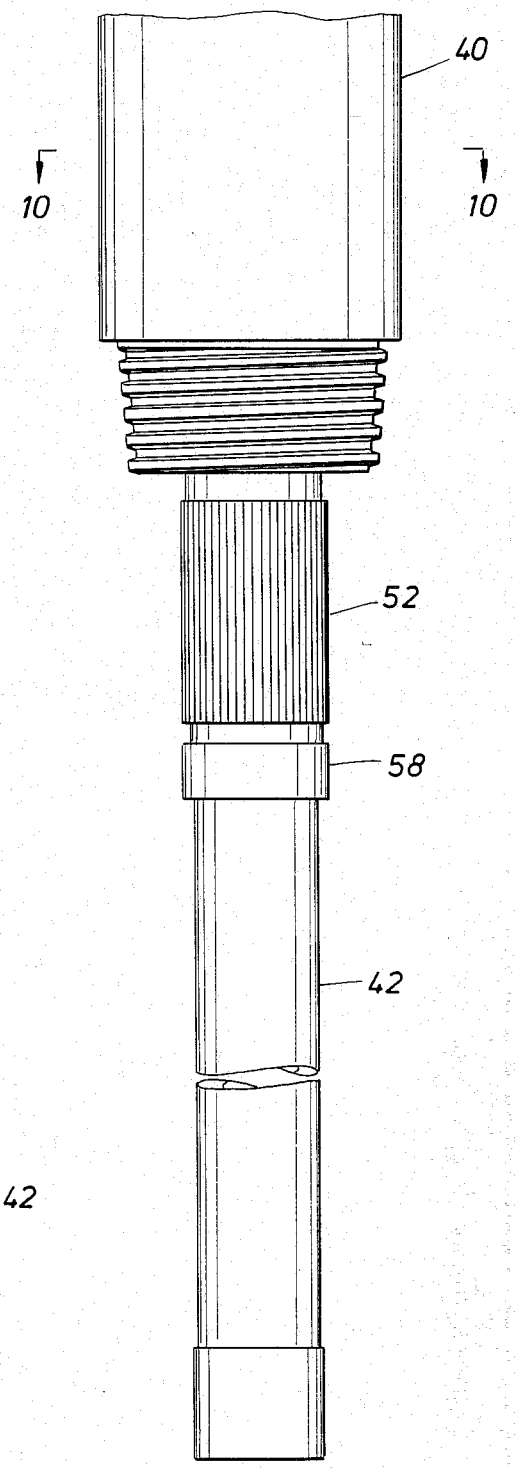
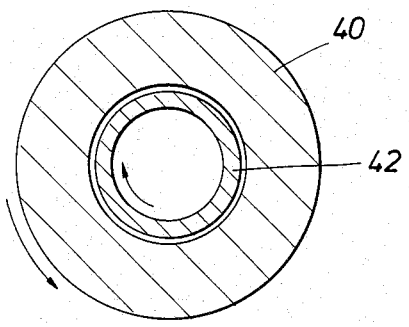
FIG. 10

METHOD AND APPARATUS FOR CONTROLLING AZIMUTHAL DRIFT OF A DRILL BIT

This invention relates to controlling the direction of a drill bit as it bores a hole in the earth's surface, generally, and in particular to a method and apparatus for controlling the compass or azimuthal direction of a drill bit in an inclined well bore.

Nearly all offshore oil and gas wells and a substantial number of on-shore wells are drilled along a path that is inclined to the vertical so that the bottom of the well bore will be displaced a preselected distance horizontally from the top of the well bore. The wells are also drilled in a preselected compass or azimuthal direction. It is not uncommon for the well planners to select more than one target along a specific azimuth or compass bearing that they want the well bore to pass through on its way to total depth. Thus, the directional driller must not only control the angle of the well bore from the vertical in order to hit the targets at specified depths and horizontal distances, but he must also control the azimuthal direction of the well bore.

It is a well known fact that drill bits rotated to the right in an inclined well bore will, most of the time, tend to turn or drift to the right of the selected bearing line. This is called "right hand walk." Under certain conditions, the bit may walk left and certainly if the pipe is rotated to the left, it would do so for the same reasons that it walks to the right under the influence of right hand rotation.

Right or left hand walk results because the drill collars have the bit bend due to their own weight in an inclined well bore. They are bent further by the compressive load placed on the drill collars. This bending of the drill collars causes the drill bit to engage the bottom of the well bore at a greater angle than that of the well bore, which results in an increase in the inclination of the well bore from the vertical as the bit continues to drill. The rate of increase in inclination, i.e. the rate the bit will "build angle" can be controlled to a great extent by the use of stabilizers in the drilling assembly.

The drill collars are also subjected to a torsional force. It has been determined that this causes the direction of the "bend" or "bow" in the drill collars to move clockwise toward the left side of the hole as viewed from above, when the torque is right hand. This reduces the angle the bit makes with the vertical, which decreases the rate it will build angle but it also causes the bit to face the bottom of the well bore at an angle in the horizontal plane. As a result, the bit will tend to walk to the right of the desired bearing line.

Generally, for any given downhole assembly of a bit several drill collars and usually at least two stabilizers, the directional driller learns that he can expect the bit to walk to the right at a fairly consistent rate. Knowing this, he compensates for it by starting his well bore at an angle to the desired bearing line such that it will curve back in time to pass through the targets much like a pilot adjusts his heading to compensate for the drift produced by a cross wind. This means, however, that he will simply pass close to the targets up the hole if he hopes to hit the bottom target. Typical amounts of right hand walk are 1° to 2° per 100'. So for a deep well, the hole will have a substantial curve in it.

The dip and direction of formations penetrated by the bit also may cause movement of the bit to the right or the left of the desired bearing line. But such movements are small and usually are not a serious problem.

It is an object of this invention to provide a method of and apparatus for controlling the azimuthal drift of a drill bit due to the gravitational, axial, and torsional forces imposed on the drill collars above the bit during a drilling operation.

It is another object of this invention to provide a method of and apparatus for prestressing a drill collar in torque a predetermined amount to control the amount of azimuthal drift of the drill bit under the expected gravitational, axial, and torsional loads imposed on the drill collar during the drilling operations.

It is another object of this invention to provide apparatus for controlling the azimuthal drift of a drill bit comprising a drill collar that includes outer and inner tubular members with one end of the inner member anchored to the outer member and the other end free to rotate relative to the outer member to allow a predetermined amount of torque to be imposed on the inner member after which the free end of the inner member is anchored to the outer member to prestress both members with a preselected torque to control the horizontal or azimuthal drift of the drill bit.

It is another object of this invention to prestress a drill collar in tension to offset the shift in the direction the drill collar bends when subjected to gravitational, axial, and torsional forces in the well bore.

These and other objects, advantages, and features of this invention will be apparent to those skilled in the art from a consideration of this specification, including the attached drawings and appended claims.

In the drawings:

FIG. 3 is a view similar to FIG. 1 except that the bottom hole assembly includes spaced stabilizers;

FIG. 4 is a top view of the inclined well bore of FIG. 3;

FIG. 5A is a cross sectional view of a well bore and a conventional drill collar located in the well bore looking down the well bore toward the bit when the well bore is inclined and the drill collar is not being subjected to torsional forces;

FIG. 5B is the position of the conventional drill collar in the well bore of FIG. 5A, when the drill collar is subjected to torsional forces;

FIG. 6A is a cross sectional view of an inclined well bore and drill collar in accordance with the present invention looking down the well bore toward the bit with the drill collar positioned when no rotation is taking place;

FIG. 6B is the position of the drill collar in the well bore of FIG. 6A when the drill collar is subjected to torsional forces;

FIG. 8 is a sectional view taken along line 8—8 of FIG. 7B;

FIG. 9 is an exploded view, in elevation, of the lower end of the drill collar of this invention preparatory to prestressing the drill collar with torsional stress of the preselected amount;

Figure 11:
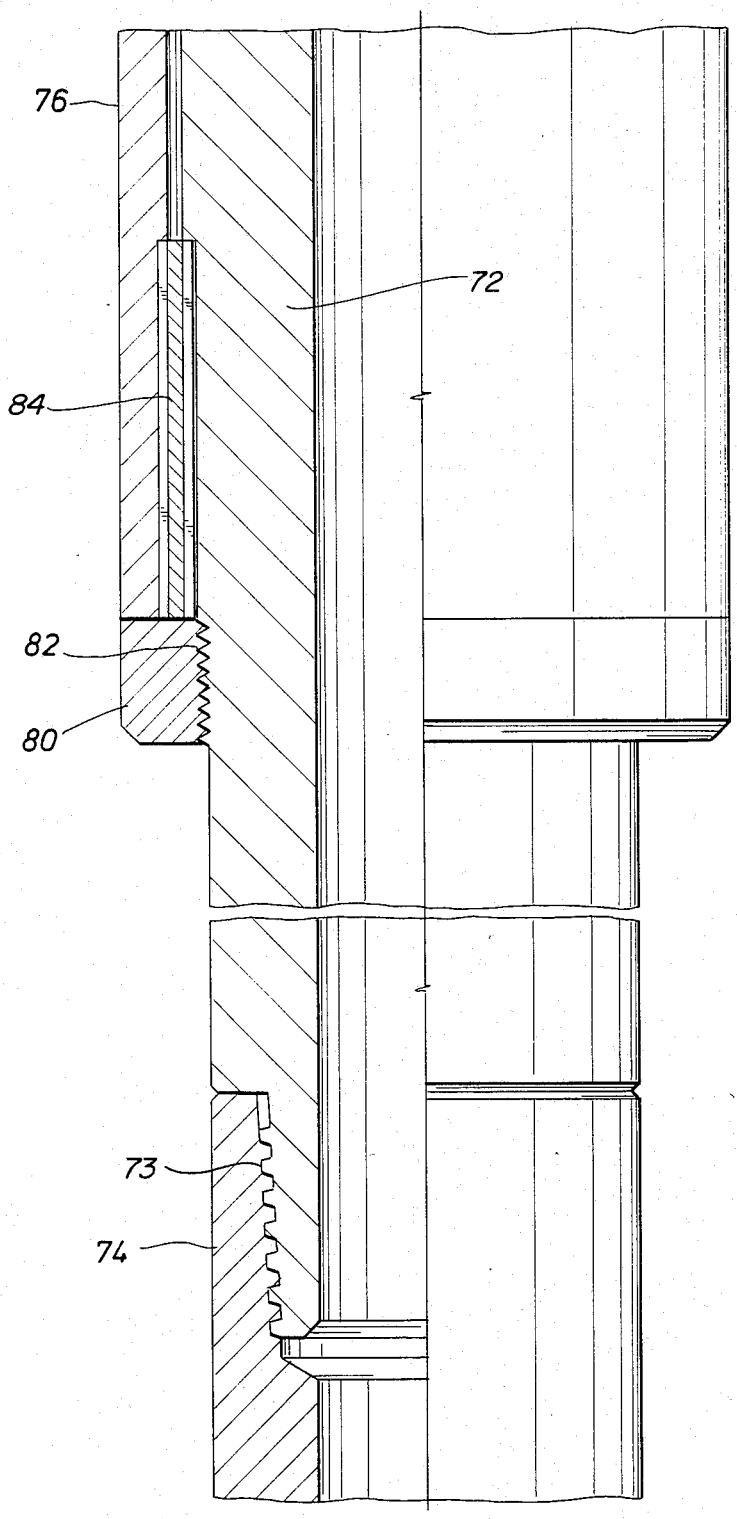

FIG. 10 is a sectional view taken along line 10—10 of FIG. 9 indicating the proper direction of relative rotation of the inner and outer members of the drill collar of this invention to prestress the members to reduce or eliminate right hand walk due to the right hand rotation of the drill string; and FIG. 11 is a view in cross section of the lower end of an alternate embodiment of the apparatus of this invention.

Figure 1:
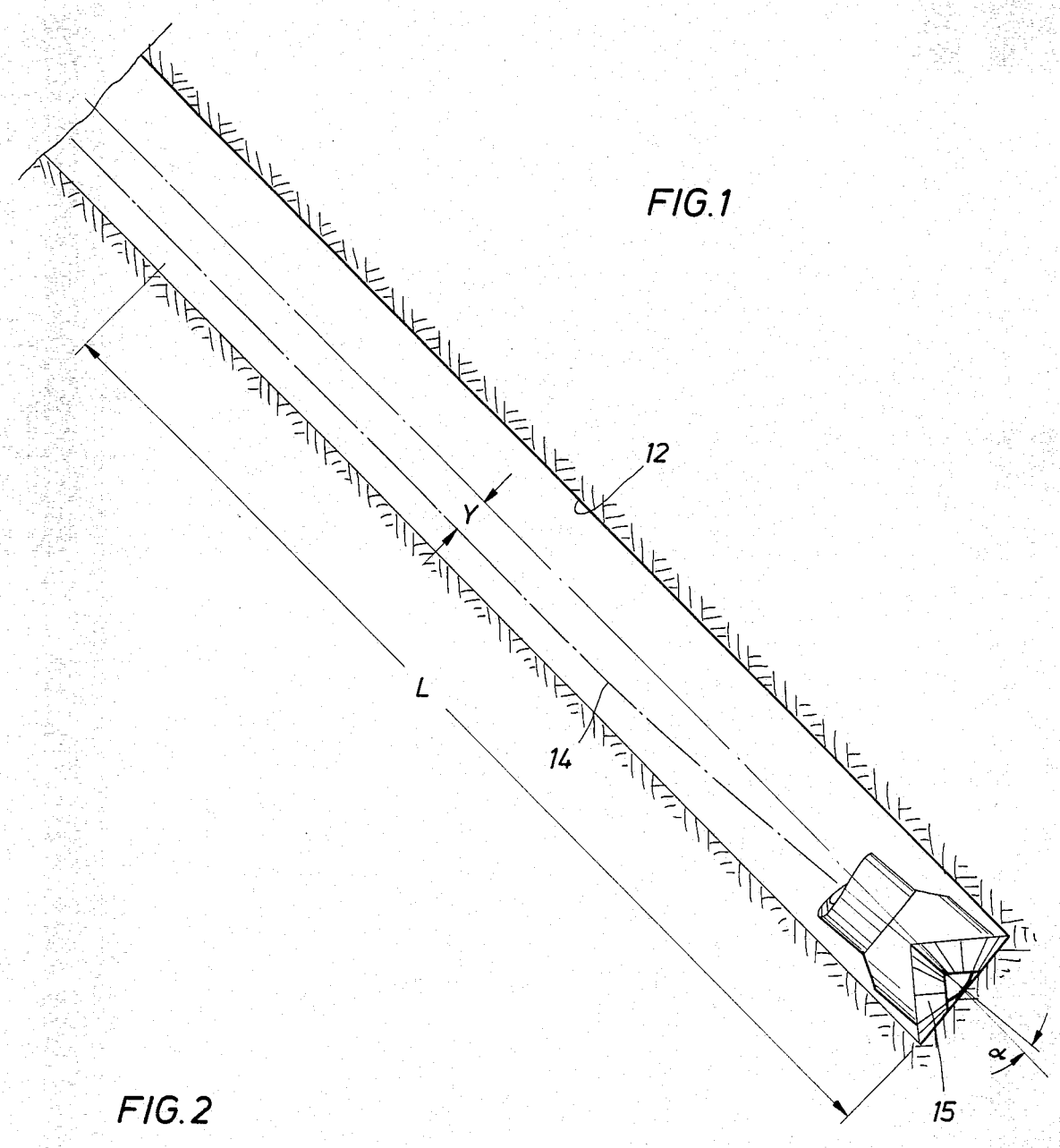
FIG. 1 is an elevational view in schematic of a drilling assembly in an inclined well bore with only the center line of the drill collars above the bit being shown to better illustrate how the drill collars move away from the center line of the well bore due to gravity and the axial load imposed on the collars.

In FIG. 1, the inclination of well bore 12 will cause the drill string 14 to move toward the low side of the well bore due to the force of gravity. There will be additional bending toward the low side of the hole in the section that is in compression. The total movement of the drill string 14 from the center line of the well bore is indicated by the letter y. This deflection will produce a bending moment on drill bit 15 causing it to tend to drill upwardly at an angle alpha, which is greatly exaggerated in the drawing. Under these conditions, the drill bit will tend to increase the angle the well bore makes with the vertical.

The angle alpha can be reduced by the use of stabilizers 16, 18, 19 as shown in FIG. 3. The diameter of the stabilizers is at or near the diameter of the well bore 17 and will hold the drill collars above the bit 20 from moving very far from the center line of the well bore. This greatly reduces the distance the unsupported drill collars between the stabilizers can move laterally away from the center line of the well bore.

In FIG. 3, the section of drill collars between the bit and first string stabilizer 16 in well bore 17 has a maximum displacement from the center line of $y_1$ and since this section of the drill collars acts as a cantilever beam, the maximum bending will occur at a point spaced $\frac{2}{3}$ of the distance between stablizer 16 and the bit. This rotates the bit through the angle alpha. The drill collars above stabilizer 16, such as those located between stabilizers 16 and 18 and between stabilizer 18 and 19 will have their maximum deflections $y_2$ and $y_3$, generally midway between the stabilizers.

Figure 2:
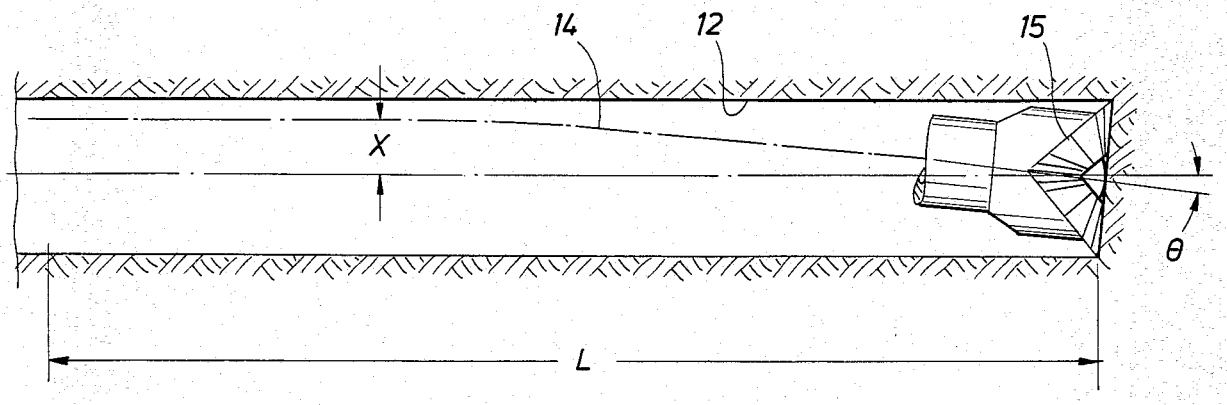
FIG. 2 is a top view of the well bore of FIG. 1 showing the displacement of the drill collars along the x or horizontal axis due to the torsional stress in the drill collars from the rotation of the bit.

It takes a substantial amount of torque to turn a drill bit with the high weights presently placed on the bits. As explained above, when the drill collars above a drill bit are subjected to torsional forces, while they are bent due to gravity and axial loading, the direction of the bend will rotate clockwise to the left of vertical as viewed from above when the pipe is turned to the right. Thus, as shown in FIG. 2, the drill string 14 will move a distance x in the horizontal direction from the center line of the well bore 12. This will change the angle of the face of the bit 15 relative to the center line of the well bore, angle theta $\theta$ in the drawing, and cause the bit to tend to drill toward the right looking downwardly along the longitudinal axis of the well bore.

In FIG. 4, assuming stabilizers 16, 18, and 19 hold the drill collars substantially in the middle of the well bore 17, the drill collars between the stabilizers will deflect to the left distances $x_1$, $x_2$, and $x_3$ due to the torsional forces imposed on the drill collars. Since some torque is required to rotate the stabilizers, the amount of torque in each section of drill collars will be different. The torque in the drill collars between the bit 20 and the first stabilizer 16 will be less than the torque in the drill collars between stabilizers 16 and 18, which in turn will be less than the torque in the drill collars between stabilizers 18 and 19.

The effect of the combination of forces acting on the drill collars is shown in FIGS. 5A and 5B. In FIG. 5A, drill collar 22 is located in inclined well bore 24. The longitudinal opening through the drill collar is not shown to simplify the drawing. Gravity and the axial compressive forces acting on the drill collar causes the collar to bend, which moves center line 22*a* to move downwardly along the y axis from center line 24*a* of the well bore 24 a distance y'. When drill collar 22 is subjected to a right hand torsional force in the direction of the arrow, center line 24*a* of the drill collar will move to the left as viewed in FIG. 5B a distance x'' along the x axis. It may or may not remain a distance y'' below the x axis so as to continue to cause the bit to build angle, but with the movement to the left of the y axis, it will also cause the bit to drill to the right along angle theta as discussed above in connection with FIGS. 2 and 4. It is not known for sure, but it is believed that the movement of the center line of the drill collar along the horizontal or x axis due to torque will cause a reduction in the distance the center line of the drill collar is below the x axis and if this is true, this would reduce the rate that the bit builds angle. Therefore, y'' is shown to be less than y'.

In accordance with the method and apparatus of this invention, the amount of right hand or left hand walk is controlled by prestressing one or more of the drill collars above the bit in torsion with the torsional stress acting in the opposite direction from the torsional stress to which the drill collar is to be subjected under drilling operations. The result of this shown in FIGS. 6A and 6B. In FIG. 6A, drill collar 26, located in inclined well bore 28, has been prestressed so that when subjected to only gravitational and axial forces, its center line 26*a* will be located to the right and below center line 28*a* of the well bore. When the drill collar is subjected to the torque produced by the drilling operations, center line 26*a* will move to the left to a position below center line 28*a* on the y axis. In this position, all tendency of the drill bit to walk to the right will be eliminated.

It is understood, of course, that the amount of prestress placed in the drill collar will be based upon assumed gravitational, axial, and torsional forces to be imposed on the drill collar in the actual drilling operation. The gravitational force and the amount the collar will bend due to it can be fairly accurately predicted. But the weight on the bit, i.e. axial loading on the drill collar, and the torque imposed on the drill collar will vary with the result that center line 26*a* of the drill collar will probably move back and forth across vertical axis y during the drilling operations. Therefore, there will be some tendency for the bit to walk to the right and also to the left from time to time, but this tendency will be greatly reduced and may even balance out if the time and distance the center line is to the right is about the same as the time and distance it is to the left.

By changing the amount the collar is prestressed, center line 26*a* can be positioned to cause a preselected right hand walk or a preselected left hand walk or, as explained above, reduce to substantially zero, the tendency to walk in either direction.

Figure 7A:
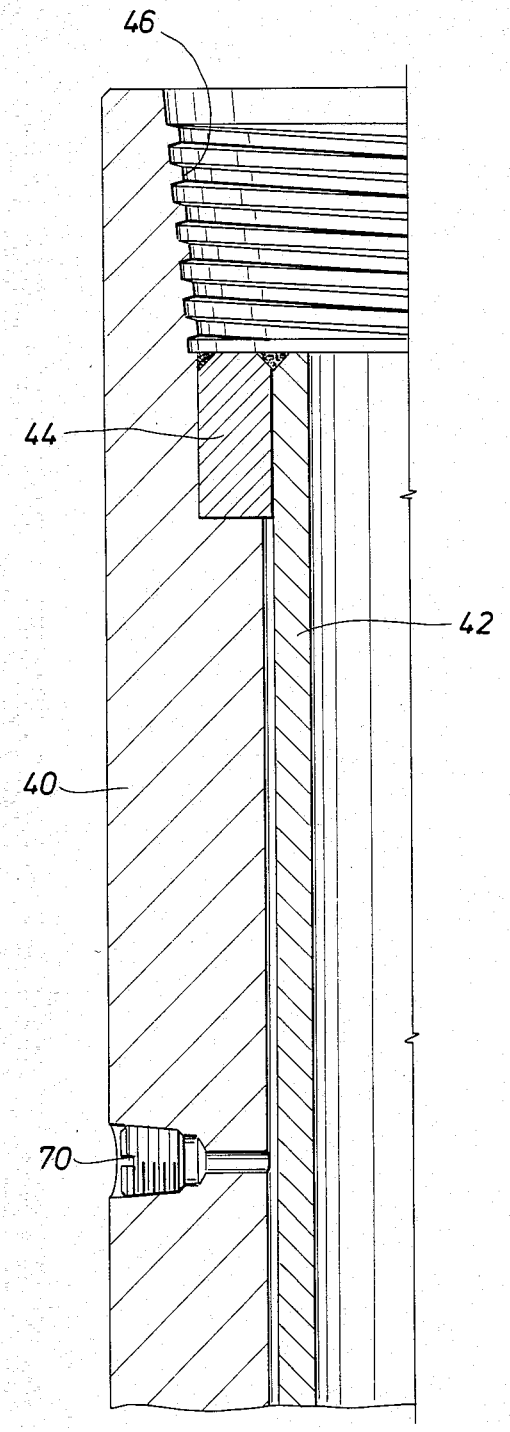
FIG. 7A is a cross sectional view of the top portion of the preferred embodiment of the apparatus or drill collar of this invention.
Figure 7B:
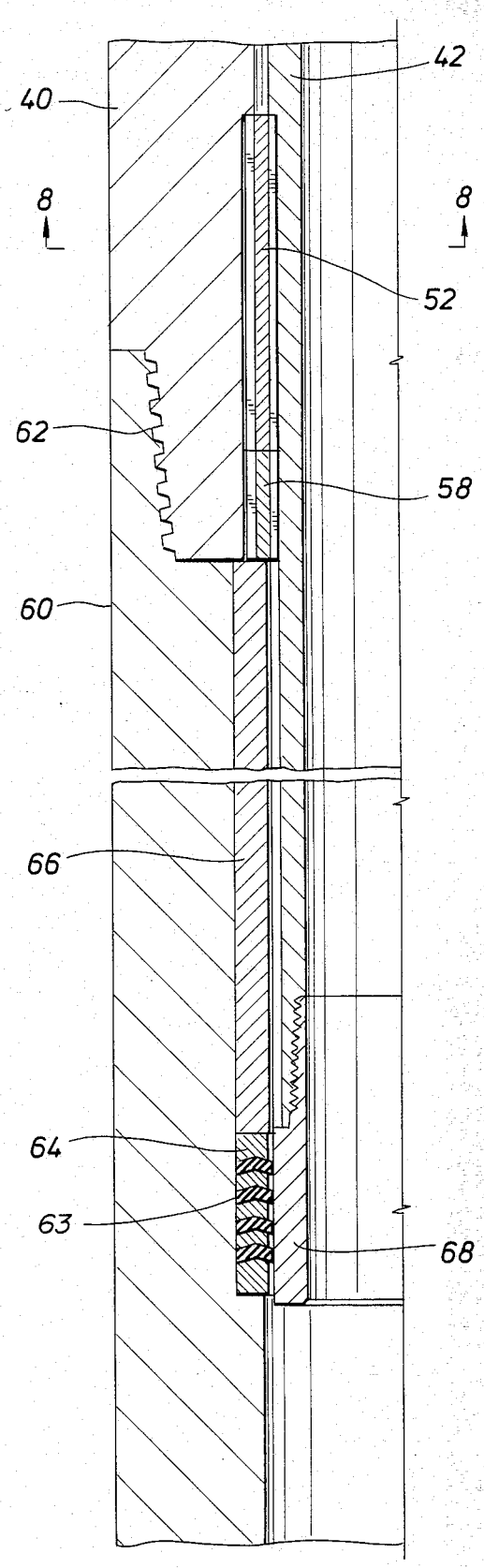
FIG. 7B is a cross sectional view of the lower portion of the preferred embodiment of the apparatus or drill collar of this invention.

The preferred embodiment of the apparatus for practicing the method of this invention is shown in FIGS. 7A and 7B. The apparatus is to be run as a drill collar, and therefore, should approach the stiffness and weight of a drill collar. It includes outer tube 40 and inner tube 42 located inside of the outer tube, in other words the tubes are telescoped. Preferably outer tube 40 is relatively thick walled to provide substantially all of the stiffness and weight required for the apparatus to act as a drill collar.

Means are provided to hold the inner and outer tubular members from relative rotation adjacent one end. In FIG. 7A, annular ring 44 encircles the upper end of inner member 42 just below tool joint 46. The ring is welded to the outer and inner tubular members to hold the tubular members from relative rotation. Tool joint 46 is a conventional threaded connection for connecting the drill collar in the drill string.

The lower end of the drill collar is shown in 7B. Means are provided to hold the inner and outer tubular members of the drill collar from relative rotation at the other end of the drill collar after the members have been rotated relative to each other to prestress the members with the desired amount of torsional stress. In the embodiment shown, and as best seen in FIG. 8, the inner surface of outer member 40 adjacent its lower end is provided with a plurality of parallel grooves 48 and inner tubular member 42 is provided on its outer surface with a similar plurality of parallel grooves 50. Annular member 52 is similarly grooved on its outer and inner surfaces to provide elongated splines 54 extending along its outer surface and splines 56 extending along its inner surface. The splines engage the grooves in the inner and outer member and hold the two members from relative rotation after the members have been rotated relative to each other a predetermined amount to provide the desired prestress in the members. Spacer 58 (FIG. 7B) holds splined member 52 in engagement with the grooves. It, in turn, is held against longitudinal movement by drilling sub 60 which, may be the bit sub. It is connected to outer member 40 through tool joint 62.

Means are provided to keep drilling mud from entering the annular space between the inner and outer members. In the embodiment shown, packing elements 63 are positioned inside drilling sub 60 between metal spacer rings 64. The packing elements and spacer rings are held in position by annular member 66, which also holds spacer 58 in position between the inner and outer members. Packing elements 63 engage the outer surface of wash pipe 68 connected to the lower end of the inner member.

Preferably, the space between the members is filled with a noncorrosive liquid through filler plug 70 shown in FIG. 7A.

Before the drill collar is assembled, it must be prestressed in accordance with this invention, and the position of the members prior to prestressing the drill collar is shown in FIG. 9. The bit sub, packing, and wash pipe have been removed. Spacer 58 and spline member 52 are in position below the outer member to move into engagement with the grooves on the inner and outer members to hold the members from relative rotation after the desired torque has been placed in the members. Inner member 42 extends beyond the lower end of outer member 40 sufficiently to allow the spline and the spacer to be so positioned with sufficient exposed surface remaining for tongs to grip the inner member to apply torque thereto. Tongs are also attached to outer member 40 and the members are rotated relative to each other the desired amount, after which they are held in their relatively rotated positions while spline 52 is moved into engagement with the grooves 48, 50 in the members. The tongs are removed and the remaining elements of the drill collar assembled. If the drill collar is to be prestressed to prevent right hand walk, the members will be rotated relative to each other in the direction shown by the arrows in FIG. 10 assuming the drill string will be rotated to the right.

The inner member, being smaller in diameter and having a thinner wall, will be rotated through a substantially larger angle then the outer member to obtain the desired prestress. For example, if the outer member is 8" in diameter with an inside diameter of 4", and the inner member has an outside diameter of $3\frac{3}{4}$" and inside diameter of 2 15/16", to prestress the members with 12,000 ft. lbs. of torque, the inner member must be rotated through an angle of about 18°, while the outer member is rotated through an angle of 0.662°. The spline will, of course, dictate the angle through which the members are rotated and obviously, it cannot accommodate any angle desired. In the drawings, the splines and grooves on the members are in 5° increments. This means that for the prestress of 12,000 ft. lbs. of torque discussed above, it would probably be better to hold back up on the outer member adjacent its upper end and put no torque in it while rotating the inner member 20°. Then after the spline is in position and the torque removed, the inner member will transfer its torque to the outer member. This will cause a small rotation of the outer member in the opposite direction which will reduce the angle through which the inner member has been rotated back toward the 18°. Obviously, if the discrepancy is too great, some of the variables may have to be adjusted.

In the alternate embodiment of the invention shown in FIG. 11, inner member 72 is a tubular member with a threaded pin 73 and box (not shown) on opposite ends so it can be connected with the pipe string directly above bit sub 74. Inner member 72 has its upper end (not shown) attached to outer member 76 to prevent relative rotation between the members at the end of the outer member. The lower end of the outer member can be rotated relative to the inner member to prestress the members in the manner described above. Spline 84 is used to hold the members in their prestressed condition. Threaded ring 80 that engages threads 82 on the inner member holds the spline in place.

From the foregoing it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

Because many other embodiments may be made of the invention without departing from the scope thereof, it is to be understood that all matter herein set forth or shown in the accompanying drawings is to be interpreted as illustrative and not in a limiting sense.

What is claimed is:

1. A method of controlling the lateral drift of a drill bit as it drills a well bore comprising the steps of calculating the angle the drill bit will make with the longitudinal axis of the well bore in the horizontal plane caused by deflection of the drill collars from gravitational and axial forces and torsional forces produced by a preselected torque from the drill bit, and prestressing the drill collars in torsion to change the angle in the horizontal plane that the bit makes with the longitudinal axis of the well bore to the desired angle when the drill collars are subjected to the preselected torque from the drill bit.

2. The method of claim 1 in which the prestressing step includes holding two telescoped tubular members from rotating relative to each other at one end of the members, rotating the other ends of the members relative to each other until the desired torsional prestress is placed in the members, and holding the other ends of the members from further rotation relative to each other.

3. Apparatus for controlling the azimuthal drift of a drill bit on the lower end of a drill string in an inclined well bore comprising a first tubular member for placing in the drill string just above the bit, a second tubular member in telescoping relationship with the first member and having one end attached to one end of the first member to allow the other ends of the first and second members to be rotated relative to each other to place a predetermined torque in the members, and means for holding the members from further rotation relative to each other to maintain said predetermined torque in the members to adjust the angle the drill bit makes in the horizontal plane with the longitudinal axis of the well bore to the desired angle when the apparatus is subjected to the expected gravitational, axial, and torsional forces of the drilling operation.

4. The apparatus of claim 3 in which the first member is outside the second member.

5. The apparatus of claim 4 in which the wall of the outer member is substantially thicker than the wall of the inner member.

6. The apparatus of claim 3 in which the holding means includes a splined member located between the members in engagement with grooves in the inner surface of the outer member and the outer surface of the inner member.

7. A drill collar for use in a drill string for controlling the azimuthal drift of a drill bit in an inclined well bore caused by the bending of the drill collar in the azimuthal direction from the gravitational, axial, and torsional forces imposed on the drill collar during drilling operations, said drill collar comprising telescoped outer and inner tubular members, means for holding the members from rotating relative to each other adjacent one end of the members and means for holding the members from rotation relative to each other adjacent the other end of the members after they have been rotated relative to each other around their longitudinal axes to prestress the members in torsion an amount that will produce a predetermined bending of the drill collar in the azimuthal direction when subjected to the expected gravitational, axial, and torsional forces of the drilling operation to produce a predetermined azimuthal drift of the drill bit.

8. An apparatus for use in a string of drill pipe for rotary directional drilling which comprises:

a. an outer tubular member;

b. an inner tubular member disposed concentrically in the outer tubular member to define an annular space therebetween, a first end of the inner tubular member rigidly connected to a first end of the outer tubular member, the second end of the inner tubular member extending beyond the second end of the outer tubular member;

c. first longitudinally disposed grooves spaced circumferentially on the inner surface of the outer tubular member;

d. second longitudinally disposed grooves spaced circumferentially on the outer surface of the inner tubular member; and e. at least one spline member to mesh with the first and the second grooves, the spline member sized to be inserted within the annular space in splined engagement with both the first and the second grooves.

9. The apparatus of claim 8 further comprising a closure device attachable to one of the tubular members to close off the annular space at the second end of the outer tubular member.

* * * * *